US009805924B2

(12) United States Patent
Jungwirth et al.

(10) Patent No.: US 9,805,924 B2
(45) Date of Patent: Oct. 31, 2017

(54) HIGH-INTENSITY DISCHARGE LAMP ASSEMBLY AND METHOD

(71) Applicant: The Boeing Company, Chicago, IL (US)

(72) Inventors: Douglas R. Jungwirth, Porter Ranch, CA (US); Anton M. Bouckaert, Simi Valley, CA (US); Christina Vlastelica, Canyon Country, CA (US)

(73) Assignee: The Boeing Company, Chicago, IL (US)

( * ) Notice: Subject to any disclaimer, the term of this patent is extended or adjusted under 35 U.S.C. 154(b) by 230 days.

(21) Appl. No.: 14/477,471

(22) Filed: Sep. 4, 2014

(65) Prior Publication Data

US 2016/0071719 A1 Mar. 10, 2016

(51) Int. Cl.

| | |
|---|---|
| ***F21V 29/00*** | (2015.01) |
| ***H01J 61/52*** | (2006.01) |
| ***H01J 61/30*** | (2006.01) |
| ***H01J 61/02*** | (2006.01) |
| ***H01J 61/86*** | (2006.01) |

(52) U.S. Cl.

CPC ..... *H01J 61/523* (2013.01); *H01J 61/025* (2013.01); *H01J 61/30* (2013.01); *H01J 61/526* (2013.01); *H01J 61/86* (2013.01)

(58) Field of Classification Search

CPC ..... H01J 61/30; H01J 61/52; H01J 61/523; H01J 61/526

USPC ..... 362/263–265, 294, 345, 373

See application file for complete search history.

(56) References Cited

U.S. PATENT DOCUMENTS

| | | | | |
|---|---|---|---|---|
| 6,400,067 | B1 | 6/2002 | Manning et al. | |
| 6,736,527 | B1 * | 5/2004 | Gibbon | F21V 29/02 352/57 |
| 7,423,366 | B2 * | 9/2008 | Koelger | F21V 29/004 313/146 |
| 7,488,096 | B2 * | 2/2009 | Childers | G03B 21/16 362/218 |

* cited by examiner

*Primary Examiner* — Jason Moon Han

(74) *Attorney, Agent, or Firm* — Walters & Wasylyna LLC

(57) ABSTRACT

A lamp assembly including a housing defining an internal volume and a lamp positioned in the internal volume, the lamp including a first electrode and a second electrode, wherein the first electrode is both thermally and electrically coupled to the housing, and wherein the second electrode is thermally coupled to the housing by way of a thermally conductive, electrically insulative material and a heat transfer element.

20 Claims, 8 Drawing Sheets

HIGH-INTENSITY DISCHARGE LAMP ASSEMBLY AND METHOD

FIELD

This application relates to the cooling of lamps and, more particularly, to the cooling of high-intensity discharge lamps, such as xenon arc lamps.

BACKGROUND

High-intensity discharge lamps are relatively compact and lightweight, yet they are capable of producing a significantly amount of illumination. Therefore, high-intensity discharge lamps are commonly used in various applications that require significant illumination intensity, such as searchlights and spotlights, image projectors, stadium lighting and the like.

Furthermore, the bright white spectral profile of certain high-intensity discharge lamps, such as xenon arc lamps, closely resembles natural sunlight. Therefore, such high-intensity discharge lamps are commonly used in solar simulators. Solar simulators facilitate the indoor testing of solar cells under carefully controlled laboratory conditions. Solar simulators are also used to test objects, such as building materials, automobiles, aircraft and space vehicles, for thermal and ultraviolet exposure issues.

The operation of high-intensity discharge lamps produces a significantly large quantity of unwanted heat. For example, certain xenon arc lamps operate at temperatures ranging from about 100° C. to about 120° C. If not adequately dissipated, the heat generated by a high-intensity discharge lamp may shorten the working life of the lamp or possibly even permanently damage the lamp and/or any surrounding structures. The high voltages required to initially ignite such lamps and to maintain such lamps in operation render it difficult to dissipate generated heat.

Accordingly, those skilled in the art continue with research and development efforts in the field of lamps and lamp cooling to address problems identified above and other, related issues.

SUMMARY

In one embodiment, the disclosed lamp assembly may include a housing defining an internal volume and a lamp positioned in the internal volume, the lamp including a first electrode and a second electrode, wherein the first electrode is both thermally and electrically coupled to the housing, and wherein the second electrode is thermally coupled to the housing but electrically isolated from the housing.

In another embodiment, the disclosed lamp assembly may include a housing defining an internal volume and a lamp positioned in the internal volume, the lamp including a first electrode and a second electrode, wherein the first electrode is both thermally and electrically coupled to the housing, and wherein the second electrode is thermally coupled to the housing by way of a thermally conductive, electrically insulative material and a heat transfer element.

In another embodiment, the disclosed lamp assembly may include a housing defining an internal volume, a lamp positioned in the internal volume, the lamp including a first electrode and a second electrode, a mounting structure connecting the first electrode to the housing, a heat transfer element thermally coupling the second electrode to the housing along a cooling pathway, and a thermally conductive, electrically insulative material positioned in the cooling pathway to electrically isolate the second electrode from the housing.

In yet another embodiment, the method for cooling a lamp may include providing a lamp and a housing, the lamp including a first electrode and a second electrode, thermally coupling and electrically coupling the first electrode with the housing, and thermally coupling the second electrode with the housing by way of a thermally conductive, electrically insulative material.

Other embodiments of the disclosed high-intensity discharge lamp assembly and method will become apparent from the following detailed description, the accompanying drawings and the appended claims.

DETAILED DESCRIPTION

Figure 1:
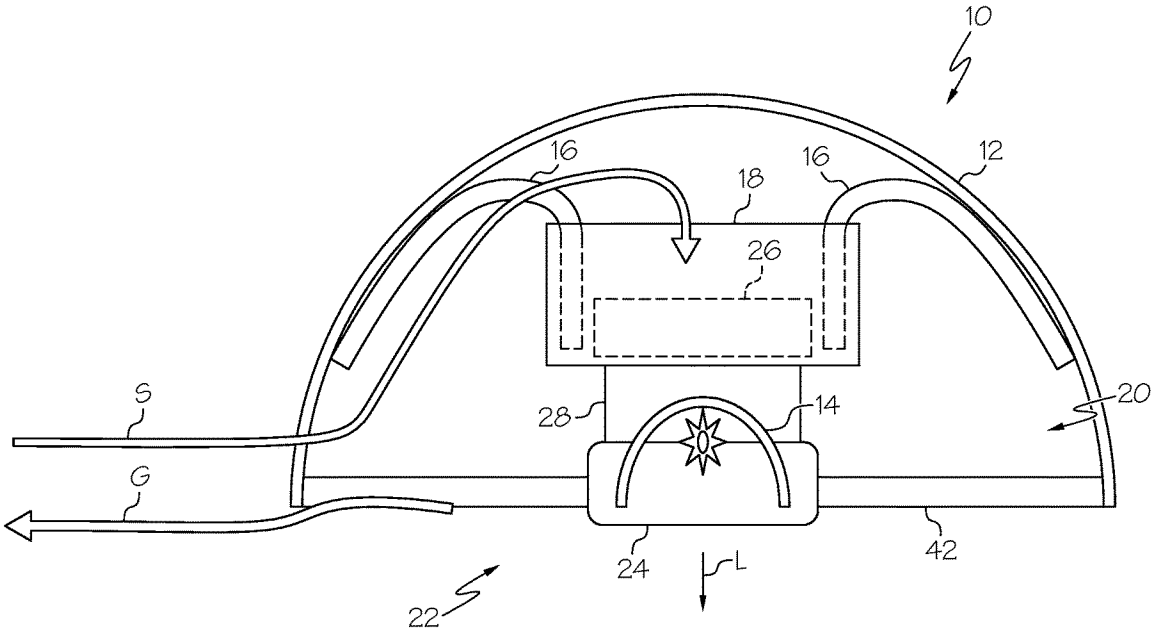
FIG. 1 is a side elevational view, partially in section, of one embodiment of the disclosed high-intensity discharge lamp assembly.
Figure 2:
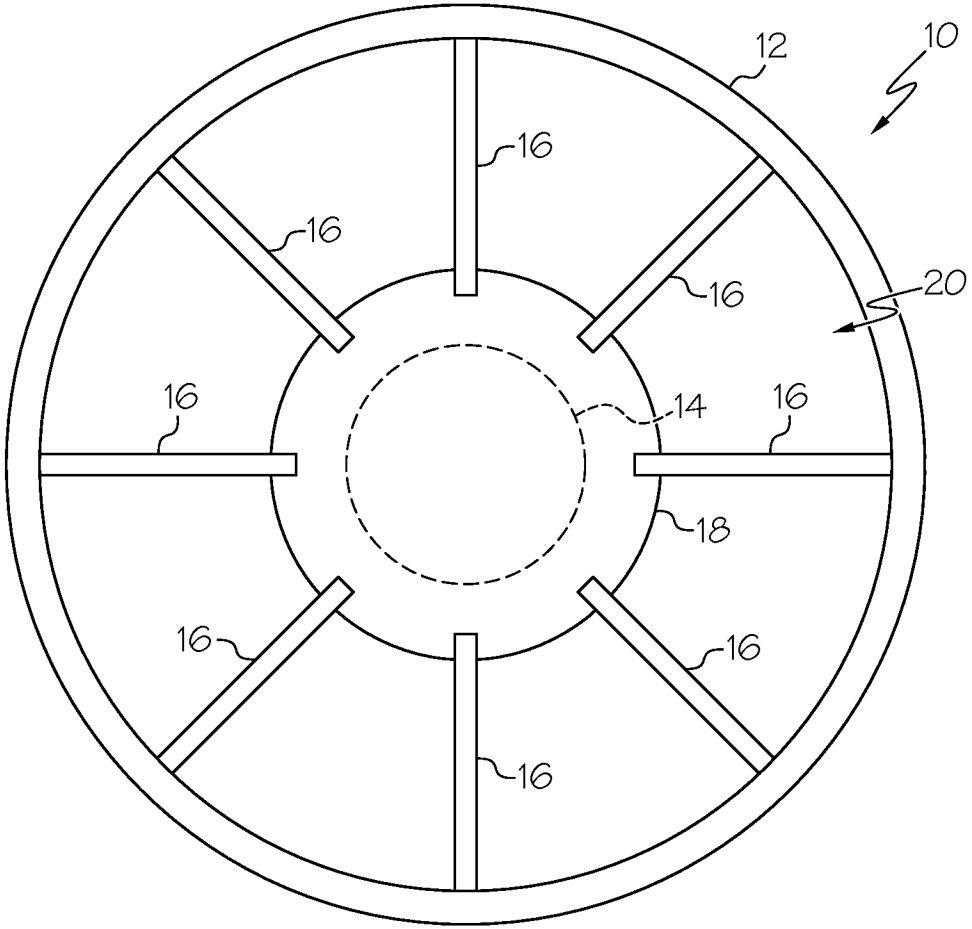
FIG. 2 is a top plan view of the high-intensity discharge lamp assembly of FIG. 1.
Figure 3:
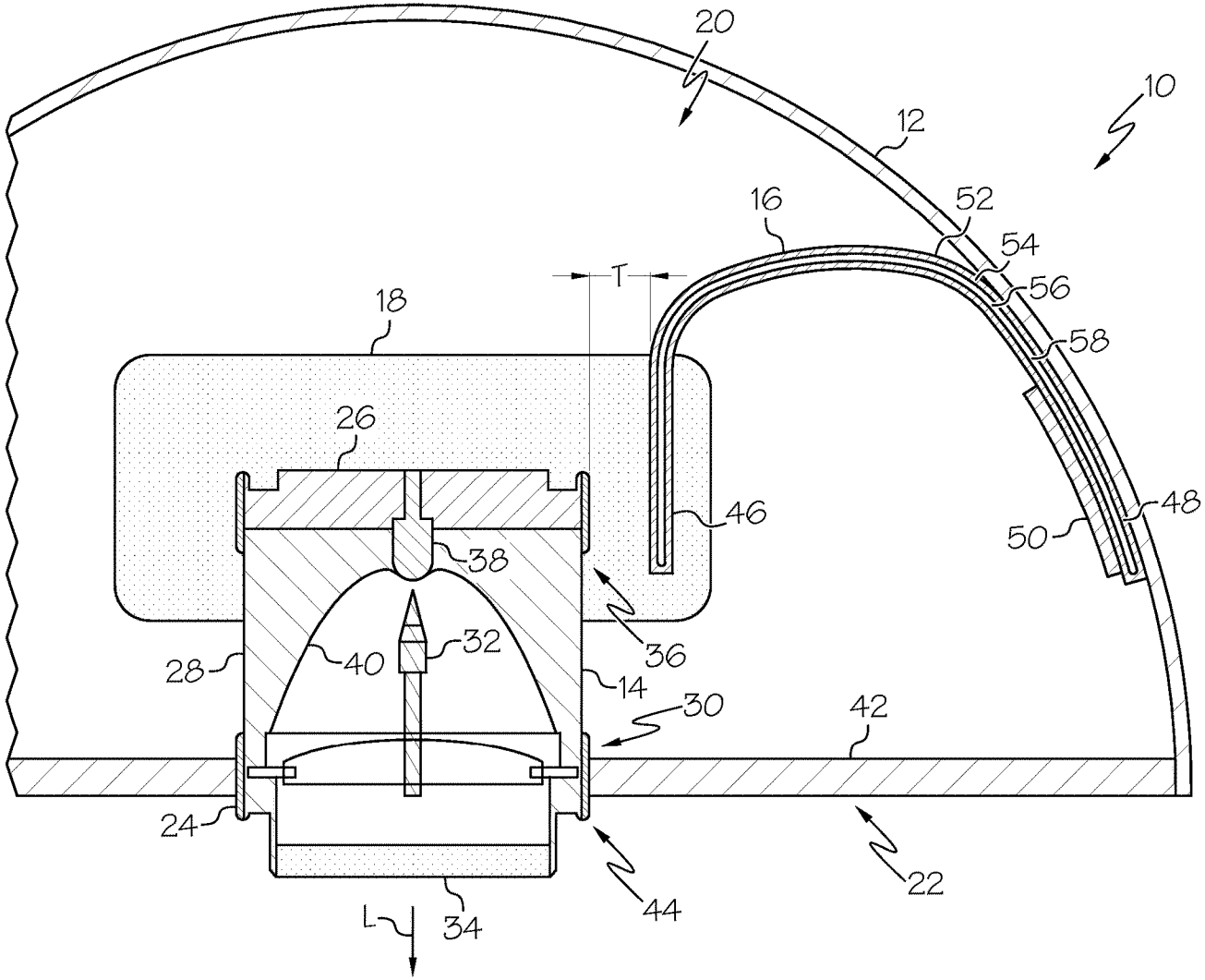
FIG. 3 is a side elevational view, in section, of a portion of the high-intensity discharge lamp assembly of FIG. 1.

Referring to FIGS. 1-3, one embodiment of the disclosed high-intensity discharge lamp assembly, generally designated 10, may include a housing 12, a lamp 14, one or more heat transport elements 16 (eight are shown in FIG. 2), and a thermally conductive, electrically insulative material 18. As is described in greater detail herein, the housing 12, the lamp 14, the heat transport elements 16 and the thermally conductive, electrically insulative material 18 may be arranged such that heat generated by the lamp 14 may be readily and effectively transferred to the housing 12 without electrically shorting the lamp 14.

The housing 12 may form the outer structure of the lamp assembly 10. Therefore, the housing 12 may provide a level of protection (e.g., from the environment) to the components of the lamp assembly 10 (e.g., the lamp 14, the heat transport elements 16 and the thermally conductive, electrically insulative material 18) housed therein. While a dome-shaped housing 12 is shown in the drawings, those skilled in the art will appreciate that housings 12 of various shapes and configurations may be used without departing from the scope of the present disclosure. For example, the shape of the housing 12 may be dictated by the shape of the lamp 14 housed therein.

The housing 12 may be formed from a material that is both thermally conductive and electrically conductive. As one general, non-limiting example, the housing 12 may be formed from a metal or metal alloy. Specific examples of metallic materials suitable for forming the housing 12 include, but are not limited to, aluminum, copper and steel (e.g., stainless steel), or alloys thereof. As another example, non-metals (e.g., composite materials) that are both thermally conductive and at least somewhat electrically conductive may be used.

Thus, the housing 12 may be electrically grounded (e.g., electrically coupled to ground G (FIG. 1)). Additionally, heat transferred from the lamp 14 to the housing 12 may ultimately be transferred to the ambient air surrounding the housing 12. Various elements, such as heat exchangers, may be employed to promote the removal of heat from the lamp assembly 10 by way of the housing 12.

The housing 12 may define an internal volume 20 and an opening 22 into the internal volume 20. The internal volume 20 may be filled with ambient air. Alternatively, a modified atmosphere may be sealed within the housing 12. As best shown in FIGS. 1 and 3, the lamp 14 may be positioned in the internal volume 20 of the housing 12 and arranged such that the light (arrow L) generated by the lamp 14 is projected outward from the housing 12 by way of the opening 22 in the housing 12.

The lamp 14 may be any apparatus or system that generates light using electrical energy. In one particular construction, the lamp 14 may be a gas discharge lamp, such as a high-intensity discharge (HID) lamp. As one specific, non-limiting example, the lamp 14 may be a xenon short-arc lamp, such as a CERMAX® xenon short-arc lamp commercially available from Excelitas Technologies Corp. of Waltham, Mass. As another specific, non-limiting example, the lamp 14 may be a xenon long-arc lamp. Multiple lamps 14 may be used within a single housing 12.

Referring to FIG. 3, the lamp 14 may include a first electrode assembly 24, a second electrode assembly 26 and a reflector assembly 28. The first electrode assembly 24 may be positioned proximate (at or near) a first end 30 of the reflector assembly 28, and may include a first electrode 32 (e.g., a cathode) and a window 34. The second electrode assembly 26 may be positioned proximate a second end 36 of the reflector assembly 28, and may include a second electrode 38 (e.g., an anode). The second electrode assembly 26 may receive electrical signals S (FIG. 1). The reflector assembly 28 may include a reflector 40, which may be parabolic, elliptical, spherical or the like, and which may project a beam of light (arrow L) through the window 34 of the first electrode assembly 24 and away from the lamp assembly 10.

A mounting structure 42 may connect the lamp 14, specifically the first electrode assembly 24 of the lamp 14, to the housing 12 and may retain the lamp 14 in the desired position and orientation relative to the housing 12. The mounting structure 42 may enclose, at least partially, the opening 22 into the internal volume 20 of the housing 12. For example, the mounting structure 42 may be a plate, such as a ground plate, positioned over the opening 22 into the internal volume 20 of the housing 12. The mounting structure 42 may define an opening 44 through which a portion of the lamp 14 may extend to project light, as shown by arrow L.

The mounting structure 42 may be formed from a material that is both thermally conductive and electrically conductive. As one general, non-limiting example, the mounting structure 42 may be formed from a metal or metal alloy. Specific examples of metallic materials suitable for forming the mounting structure 42 include, but are not limited to, aluminum and steel (e.g., stainless steel). Non-metals (e.g., composite materials) that are both thermally conductive and electrically conductive may also be used.

Thus, the mounting structure 42 may both electrically couple and thermally couple the first electrode assembly 24 of the lamp 14 to the housing 12. As such, the mounting structure 42 may provide an electrical pathway from the first electrode assembly 24 of the lamp 14 to ground G (FIG. 1), and may provide a thermal cooling pathway for heat to transfer from the first electrode assembly 24 of the lamp 14 to the housing 12.

The second electrode assembly 26 of the lamp 14 may be potted in the thermally conductive, electrically insulative material 18, such as in the form of a heat spreader. Additionally, the hot end portion 46 of each heat transport element 16 may be potted in the thermally conductive, electrically insulative material 18. The opposed, cold end portion 48 of each heat transport element 16 may be thermally coupled to the housing 12. An optional fastener 50, such as a mechanical fastener (e.g., a clip, a clamp or the like) or an adhesive-based fastener (e.g., a tape), may maintain touching engagement (physical contact), and thus thermal contact, of the cold end portion 48 of each heat transport element 16 with the housing 12.

Thus, the thermally conductive, electrically insulative material 18 may thermally couple the hot end portion 46 of each heat transport element 16 with the second electrode assembly 26 of the lamp 14, thereby thermally coupling the second electrode assembly 26 with the housing 12. Additionally, the thermally conductive, electrically insulative material 18 may electrically isolate the hot end portion 46 of each heat transport element 16 from the second electrode assembly 26.

While the lamp assembly 10 is shown in FIG. 2 with eight heat transport elements 16, fewer than eight (e.g., only one) or more than eight may be used without departing from the scope of the present disclosure. Those skilled in the art will appreciate that the number of heat transport elements 16 used in a particular lamp assembly 10 may depend on various factors, including the size of the lamp 14 and the effective thermal conductivity of the heat transport elements 16. Furthermore, while the heat transport elements 16 are shown and described cooling the second electrode assembly 26, the first electrode assembly 24 may be similarly cooled with heat transfer elements 16.

A gap T of sufficient magnitude may be provided between the hot end portion 46 of each heat transport element 16 and the second electrode assembly 26, thereby avoiding the risk of arcing or otherwise shorting out to ground G (FIG. 1) by way of the heat transport elements 16. Those skilled in the art will appreciate that the magnitude of the gap T may depend on, among other factors, the composition of the thermally conductive, electrically insulative material 18. As one specific, non-limiting example, the gap T may be at least ⅛ of an inch, such as at least ¼ of an inch or at least ½ of an inch.

The thermally conductive, electrically insulative material 18 may be any material or combination of materials capable of conducting significant quantities of heat from the second electrode assembly 26 to the heat transport elements 16, while significantly inhibiting the flow of electrical current between the second electrode assembly 26 and the heat transport elements 16. In one expression, the thermally conductive, electrically insulative material 18 may have a thermal conductivity of at least about 0.5 W/m-K, such as at least about 0.6 W/m-K or at least about 1 W/m-K or at least about 10 W/m-K. In another expression, the thermally conductive, electrically insulative material 18 may have a resistivity (at 20° C.) of at least about 1 Ωm, such as at least about 10 Ωm or at least 100 Ωm.

Various materials may be used as the thermally conductive, electrically insulative material 18. Examples of materials suitable for use as the thermally conductive, electrically insulative material 18 include, but are not limited to, epoxies, adhesives, pastes (whether curable or not), resins (whether curable or not), gels, oils and non-electrically conductive composites.

In one particular implementation, the thermally conductive, electrically insulative material 18 may be a thermally conductive, electrically insulative epoxy. One specific, non-limiting example of a thermally conductive, electrically insulative epoxy suitable for use as the thermally conductive, electrically insulative material 18 is MASTERBOND® Supreme 10AOHT single component epoxy, which is commercially available from Master Bond, Inc., of Hackensack, N.J. Another specific, non-limiting example of a thermally conductive, electrically insulative epoxy suitable for use as the thermally conductive, electrically insulative material 18 is MASTERBOND® EP21TDCANHT two-component epoxy, which is also commercially available from Master Bond, Inc.

The heat transport elements 16 may be any apparatus or system capable of transferring heat from the lamp 14 to the housing 12. In a simple realization, a heat transport element 16 may include a thermally conductive material (e.g., copper wire or tubing) that is elongated between the hot end portion 46 of the heat transport element 16 and the cold end portion 48. Heat may be transferred by conduction. In a more effective realization, the heat transport elements 16 may transfer heat by employing a working fluid that undergoes a phase transition.

In one specific realization, the heat transport elements 16 may be (or may include) heat pipes. For example, as shown in FIG. 3, each heat pipe heat transport element 16 may include a housing 52 (e.g., an elongated housing) that houses a wick-like material 54 and a working fluid 56. The wick-like material 54 may line the inner wall of the housing 52 and may define an elongated chamber 58 that extends from proximate the hot end portion 46 of the heat transport element 16 to proximate the cold end portion 48. The working fluid 56 may be evaporated proximate the hot end portion 46 of the heat transport element 16 and may be condensed proximate the cold end portion 48, thereby effectively transferring heat from the lamp 14 to the housing 12. Those skilled in the art will appreciate that various heat pipe technologies may be used without departing from the scope of the present disclosure.

Optionally, the heat transport elements 16 may be flexible. For example, the heat transport elements 16 may be shaped (e.g., bent) to closely conform to the contour of the housing 12, thereby providing the physical contact necessary to efficiently transfer heat to the housing 12.

Figure 4:
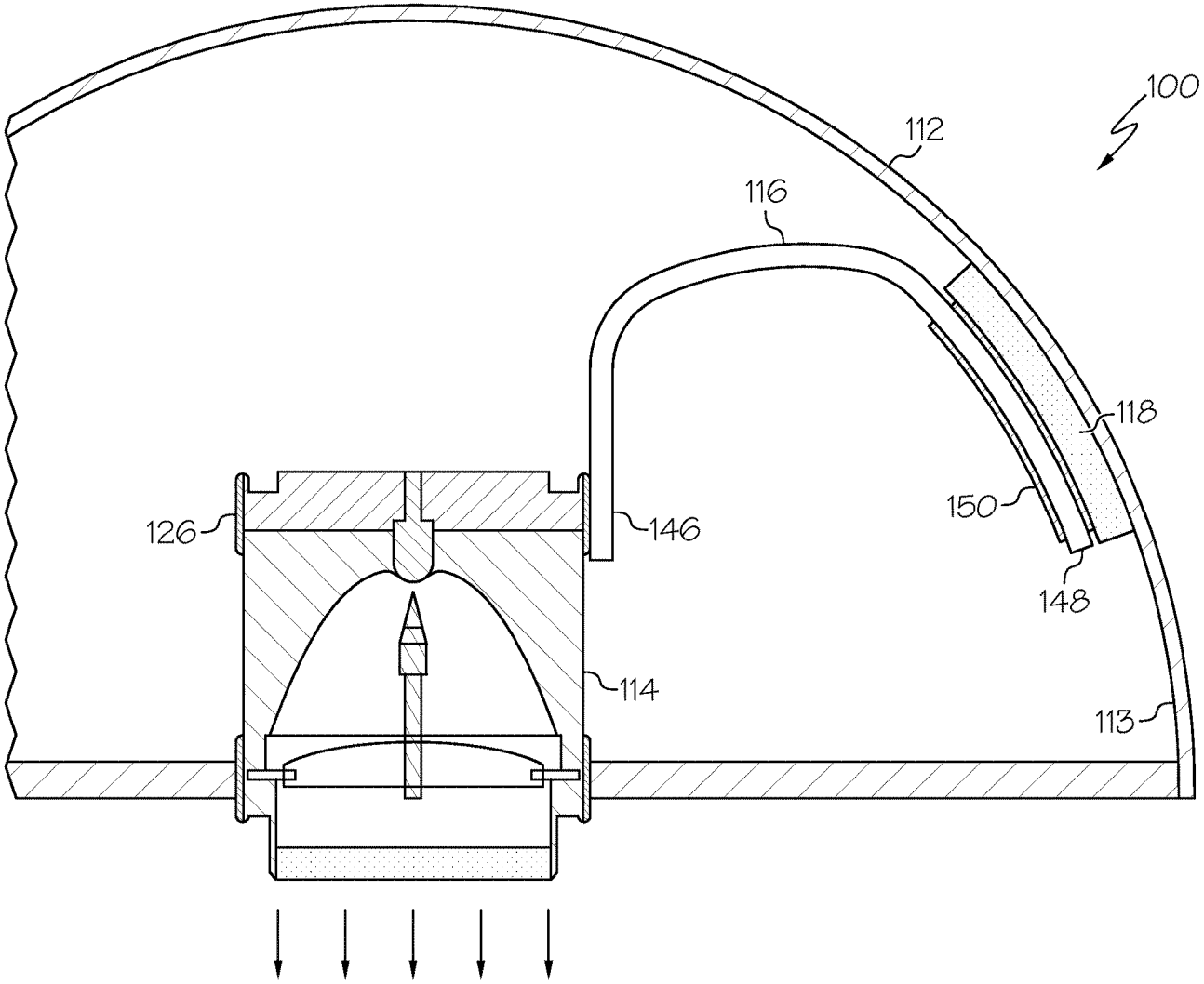
FIG. 4 is a side elevational view, in section, of another embodiment of the disclosed high-intensity discharge lamp assembly.

Referring to FIG. 4, another embodiment of the disclosed high-intensity discharge lamp assembly, generally designated 100, may include a housing 112, a lamp 114, one or more heat transport elements 116 (only one is shown in FIG. 4), and a thermally conductive, electrically insulative material 118. The housing 112, the lamp 114, the heat transport elements 116 and the thermally conductive, electrically insulative material 118 may be arranged such that heat generated by the lamp 114 may be readily and effectively transferred to the housing 112 without electrically shorting the lamp 114.

The configuration of lamp assembly 100 may be substantially the same or similar to the configuration of lamp assembly 10, with the exception of the location of the thermally conductive, electrically insulative material 118. Specifically, rather than having the second electrode assembly 126 of the lamp 114 and the hot end portion 146 of the heat transport element 116 potted in the thermally conductive, electrically insulative material 118, the thermally conductive, electrically insulative material 118 may be positioned between the housing 112 and the cold end portion 148 of the heat transport element 116, thereby allowing heat to transfer from the heat transport element 116 to the housing 112, while electrically isolating the housing 112 from the heat transport element 116.

Various configurations may be used. As one example, the thermally conductive, electrically insulative material 118 may be formed as a patch on the inner surface 113 of the housing 112, and the cold end portion 148 of the heat transport element 116 may be connected to the patch of the thermally conductive, electrically insulative material 118, such as with a fastener 150 (e.g., a mechanical fastener). As another example, the thermally conductive, electrically insulative material 118 may be physically connected to the inner surface 113 of the housing 112, and the cold end portion 148 of the heat transport element 116 may be potted in the thermally conductive, electrically insulative material 118.

Thus, the thermally conductive, electrically insulative material 118 may thermally couple the cold end portion 148 of the heat transport element 116 with the housing 112. Additionally, since the heat transport element 116 may be electrically hot due to direct contact with the second electrode assembly 126 of the lamp 114, the thermally conductive, electrically insulative material 118 may electrically isolate the cold end portion 148 of the heat transport element 116 from the housing 112.

Figure 5:
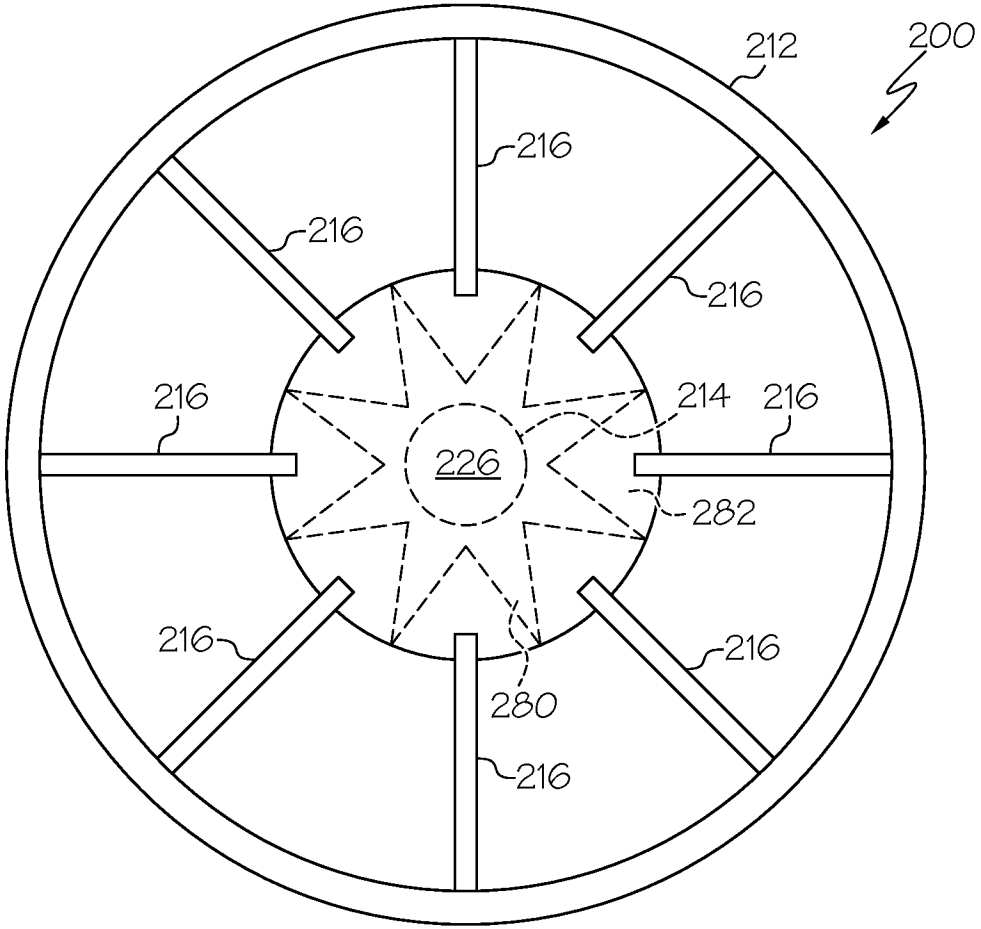
FIG. 5 is a top plan view of yet another embodiment of the disclosed high-intensity discharge lamp assembly.
Figure 6:
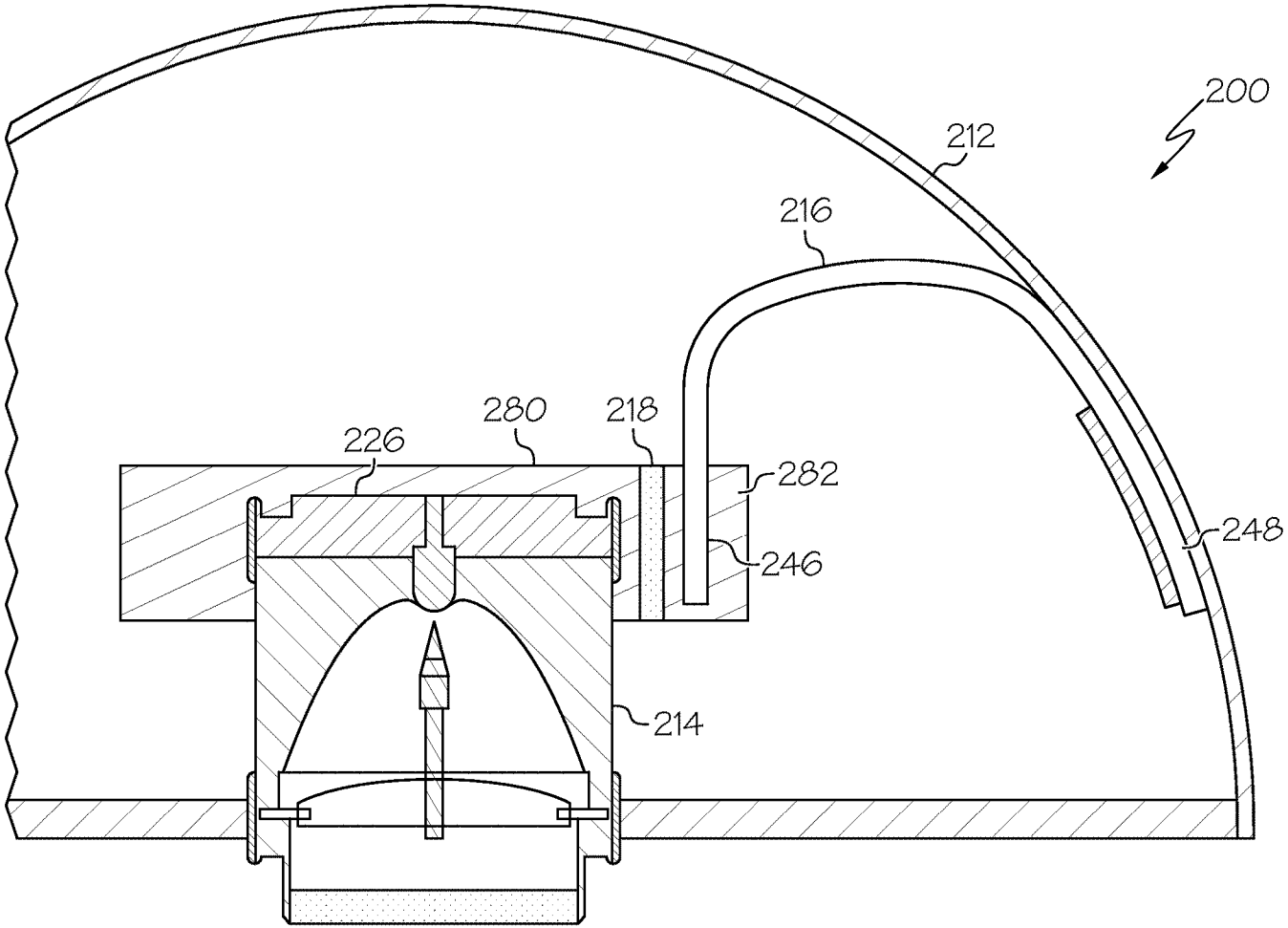
FIG. 6 is a side elevational view, in section, of a portion of the high-intensity discharge lamp assembly of FIG. 5.
Figure 7:
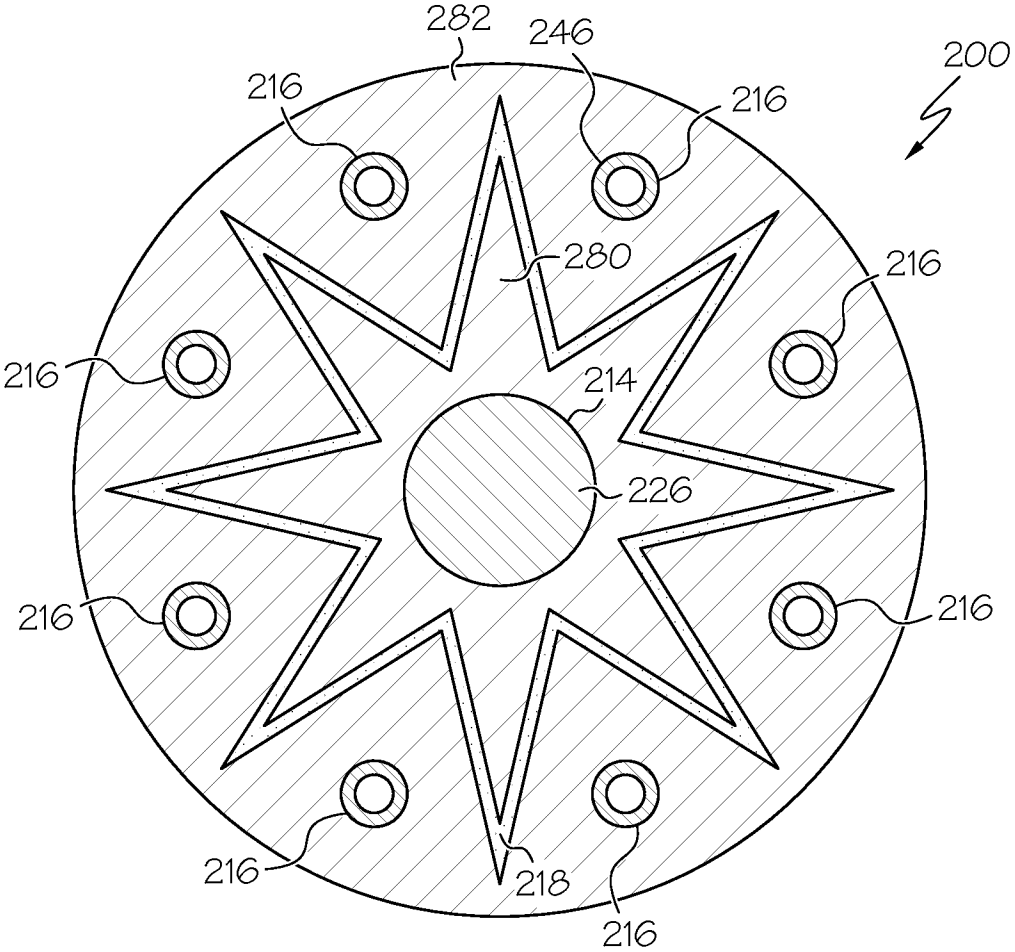
FIG. 7 is a top plan view, in section, of a portion of the high-intensity discharge lamp assembly of FIG. 5.

Referring to FIGS. 5-7, yet another embodiment of the disclosed high-intensity discharge lamp assembly, generally designated 200, may include a housing 212, a lamp 214, a plurality of heat transport elements 216, a thermally conductive, electrically insulative material 218, a first (inner) heat spreader 280 and a second (outer) heat spreader 282. The housing 212, the lamp 214, the heat transport elements 216, the thermally conductive, electrically insulative material 218, the first heat spreader 280 and the second heat spreader 282 may be arranged such that heat generated by the lamp 214 may be readily and effectively transferred to the housing 212 without electrically shorting the lamp 214.

The configuration of lamp assembly 200 may be substantially the same or similar to the configuration of lamp assembly 10, with the exception of the addition of the first heat spreader 280 and the second heat spreader 282. Specifically, rather than having the second electrode assembly 226 of the lamp 214 and the hot end portion 246 of each heat transport element 216 potted in the thermally conductive, electrically insulative material 218, the first heat spreader 280 may be connected to the second electrode assembly 226 and the thermally conductive, electrically insulative material 218 may be positioned between the first heat spreader 280 and the hot end portion 246 of each heat transport element 216. For example, the hot end portion 246 of each heat transport element 216 may be connected to the second heat spreader 282, and the thermally conductive, electrically insulative material 218 may be positioned between the first heat spreader 280 and the second heat spreader 282.

The first and second heat spreaders 280, 282 may be formed from a highly thermally conductive material, such as a metal (e.g., copper) or metal alloy (e.g., an aluminum alloy). Therefore, the first and second heat spreaders 280, 282 may be electrically conductive. While the first heat spreader 280 is shown having a star shape, any shape and/or configuration may be used that effectively increases the surface area of the second electrode assembly 226 of the lamp 214.

Thus, the first heat spreader 280, the thermally conductive, electrically insulative material 218, and the second heat spreader 282 may readily transfer heat away from the second electrode assembly 226 of the lamp 214 and to the hot end portions 246 of the heat transport elements 216. However, the thermally conductive, electrically insulative material 218 may electrically isolate the first heat spreader 280 from the second heat spreader 282 and, as such, from the heat transport elements 216.

In one alternative embodiment, the second heat spreader 282 may be omitted and/or substituted with additional quantities of the thermally conductive, electrically insulative material 218. For example, the first heat spreader 280 (which may be connected to the second electrode assembly 226 of the lamp 214) and the hot end portion 246 of each heat transport element 216 may be potted in the thermally conductive, electrically insulative material 218. A gap of sufficient magnitude may be provided between the hot end portions 246 of the heat transport elements 216 and the first heat spreader 280, thereby avoiding the risk of arcing or otherwise shorting out to ground by way of the heat transport elements 216.

Figure 8:
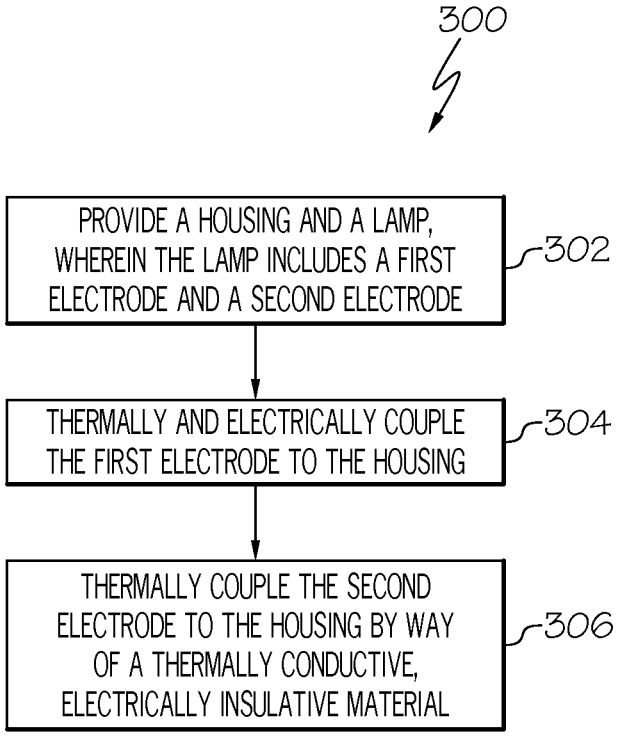
FIG. 8 is a flow diagram depicting one embodiment of the disclosed method for cooling a lamp, such as a high-intensity discharge lamp.

Referring to FIG. 8, also disclosed is a method, generally designated 300, for cooling a lamp, such as a high-intensity discharge (HID) lamp (e.g., a xenon arc lamp). The method 300 may begin at Block 302 with the step of providing a lamp housed in a housing. The housing may be electrically grounded. The lamp may include a first electrode (e.g., a cathode) and a second electrode (e.g., an anode).

At Block 304, the first electrode of the lamp may be both thermally coupled and electrically coupled to the housing. For example, a mounting structure (e.g., a ground plate) may connect the first electrode of the lamp to the housing and may retain the lamp in the desired position and orientation relative to the housing. The mounting structure may enclose, at least partially, the opening into the internal volume of the housing.

At Block 306, the second electrode of the lamp may be thermally coupled to the housing by way of a thermally conductive, electrically insulative material. One or more heat transfer elements, such as a heat pipe, may be included in the thermal pathway between the second electrode and the housing. The thermally conductive, electrically insulative material may form a portion of the thermal pathway between the second electrode and the housing, and may also electrically isolate the housing from the second electrode.

Accordingly, the disclosed high-intensity discharge lamp assembly and method may provide the ability to effectively cool a lamp, such as a xenon arc lamp that may operate at temperatures in excess of 100° C., without creating an electrical short, even during the initial, high-voltage ignition of the lamp.

Although various embodiments of the disclosed high-intensity discharge lamp assembly and method have been shown and described, modifications may occur to those skilled in the art upon reading the specification. The present application includes such modifications and is limited only by the scope of the claims.

What is claimed is:

1. A lamp assembly comprising:

a housing defining an internal volume;

a lamp positioned in the internal volume, the lamp comprising:

a cathode thermally and electrically coupled to the housing; and an anode thermally coupled to and electrically isolated from the housing;

a heat transfer element extending between the anode and the housing in the internal volume and thermally coupling the anode to the housing along a conductive cooling pathway; and a thermally conductive, electrically insulative material positioned in the conductive cooling pathway and electrically isolating the anode from the housing.

2. The lamp assembly of claim 1 wherein the housing is electrically grounded.

3. The lamp assembly of claim 1 wherein the housing is formed from a metallic material that is both thermally and electrically conductive.

4. The lamp assembly of claim 3 wherein the metallic material is one of aluminum, aluminum alloy, steel, copper and copper alloy.

5. The lamp assembly of claim 1 wherein the lamp comprises one of a gas discharge lamp and a xenon arc lamp.

6. The lamp assembly of claim 1 further comprising a mounting structure connecting the lamp to the housing, wherein the mounting structure thermally and electrically couples the cathode to the housing.

7. The lamp assembly of claim 1 wherein the thermally conductive, electrically insulative material comprises at least one of an epoxy, an adhesive, a curable paste, a non-curable paste, a curable resin, a non-curable resin, a gel, an oil and a non-electrically conductive composite.

8. The lamp assembly of claim 7 wherein the thermally conductive, electrically insulative material comprises a thermal conductivity of at least about 0.5 W/m-K and a resistivity at 20° C. of at least about 1 Ωm.

9. The lamp assembly of claim 1 wherein the heat transfer element comprises one of a heat pipe and a working fluid housed in an elongated housing.

10. The lamp assembly of claim 1 wherein the heat transfer element comprises a hot end portion thermally coupled to the anode and a cold end portion thermally coupled to the housing.

11. The lamp assembly of claim 10 wherein the thermally conductive, electrically insulative material is positioned between the anode and the hot end portion.

12. The lamp assembly of claim 10 wherein the thermally conductive, electrically insulative material is positioned between the cold end portion and the housing.

13. The lamp assembly of claim 1 further comprising a first heat spreader thermally coupled to the anode.

14. The lamp assembly of claim 13 further comprising a second heat spreader, wherein the heat transfer element is connected to the second heat spreader.

15. The lamp assembly of claim 14 wherein the thermally conductive, electrically insulative material is positioned between the first heat spreader and the second heat spreader.

16. A lamp assembly comprising:

a housing defining an internal volume;

a lamp positioned in the internal volume, the lamp comprising:

a first electrode thermally and electrically coupled to the housing; and a second electrode thermally coupled to and electrically isolated from the housing;

a heat pipe extending between the second electrode and the housing in the internal volume and thermally coupling the second electrode to the housing along a conductive cooling pathway; and a thermally conductive, electrically insulative material positioned in the conducting cooling pathway and electrically isolating the second electrode from the housing.

17. The lamp assembly of claim 16 wherein the first electrode is a cathode and the second electrode is an anode.

18. The lamp assembly of claim 16 wherein the heat pipe comprises a hot end portion thermally coupled to the second electrode and a cold end portion thermally coupled to the housing.

19. The lamp assembly of claim 18 wherein the thermally conductive, electrically insulative material is positioned between the second electrode and the hot end portion.

20. The lamp assembly of claim 18 wherein the thermally conductive, electrically insulative material is positioned between the cold end portion and the housing.

* * * * *